US009688936B2

(12) United States Patent
Jeon et al.

(10) Patent No.: US 9,688,936 B2
(45) Date of Patent: Jun. 27, 2017

(54) LUBE BASE OIL COMPRISING X-TYPE DIESTER ACID DIMER AND METHOD FOR PREPARING THE SAME

(71) Applicants: SK Innovation Co., Ltd., Seoul (KR); SK Lubricants Co., Ltd., Seoul (KR)

(72) Inventors: Hee Jung Jeon, Daejeon (KR); Yong Woo Kim, Daejeon (KR)

(73) Assignees: SK Innovation Co., Ltd., Seoul (KR); SK Lubricants Co., Ltd., Seoul (KR)

( * ) Notice: Subject to any disclaimer, the term of this patent is extended or adjusted under 35 U.S.C. 154(b) by 80 days.

(21) Appl. No.: 14/877,181

(22) Filed: Oct. 7, 2015

(65) Prior Publication Data

US 2016/0097014 A1 Apr. 7, 2016

(30) Foreign Application Priority Data

Oct. 7, 2014 (KR) ..... 10-2014-0134784

(51) Int. Cl.

| | |
|---|---|
| ***C10M 105/32*** | (2006.01) |
| ***C10M 105/36*** | (2006.01) |
| ***C10M 177/00*** | (2006.01) |
| ***C10M 109/02*** | (2006.01) |

(52) U.S. Cl.

CPC ..... *C10M 105/36* (2013.01); *C10M 109/02* (2013.01); *C10M 177/00* (2013.01); *C10M 105/32* (2013.01); *C10M 2207/2805* (2013.01); *C10M 2207/2825* (2013.01); *C10N 2220/022* (2013.01); *C10N 2220/026* (2013.01); *C10N 2230/64* (2013.01)

(58) Field of Classification Search

CPC .. C10M 2209/1003; C10M 2209/1023; C10M 2207/2805; C10M 2207/2825

USPC ..... 508/459–505

See application file for complete search history.

(56) References Cited

U.S. PATENT DOCUMENTS

| | | | | |
|---|---|---|---|---|
| 5,064,547 | A * | 11/1991 | Rubin | C10M 111/00 508/440 |
| 6,835,324 | B1 * | 12/2004 | DiFranco | C07C 51/353 252/182.18 |
| 6,908,887 | B2 * | 6/2005 | Thaemlitz | C09K 8/035 507/131 |
| 7,238,649 | B2 * | 7/2007 | Jones | C09K 8/584 252/71 |
| 7,544,645 | B2 * | 6/2009 | Miller | C07C 69/67 508/485 |
| 7,850,841 | B2 * | 12/2010 | Koivusalmi | C07C 9/22 208/18 |
| 7,867,959 | B2 * | 1/2011 | Miller | C07C 5/2506 508/496 |

(Continued)

*Primary Examiner* — Ellen McAvoy

(74) *Attorney, Agent, or Firm* — The Webb Law Firm

(57) ABSTRACT

The present invention relates to a preparation method of a lube base oil including a conversion of biomass fat to a fatty acid; a separation of a C18 unsaturated fatty acid from the fatty acid; a maximization of an oleic acid content through partial hydrotreating of the C18 unsaturated fatty acid; a synthesis of a dimer or higher-order oligomer through an oligomerization of the oleic acid; and an esterification of the oligomer, and relates to a lube base oil prepared therefrom. The lube base oil of the present invention contains an x-type diester dimer and has an excellent low-temperature stability and a high biodegradability resulting from its chemical structure, thus being ecofriendly.

14 Claims, 4 Drawing Sheets

(56) References Cited

U.S. PATENT DOCUMENTS

| | | | | |
|---|---|---|---|---|
| 7,888,542 | B2 * | 2/2011 | Koivusalmi | C10M 107/10<br>585/326 |
| 8,188,019 | B2 * | 5/2012 | Elomari | B01J 23/26<br>508/485 |
| 8,410,033 | B2 * | 4/2013 | Zhou | C10M 105/36<br>435/135 |

* cited by examiner

LUBE BASE OIL COMPRISING X-TYPE DIESTER ACID DIMER AND METHOD FOR PREPARING THE SAME

CROSS-REFERENCE TO RELATED APPLICATION

This application claims priority to Korean Patent Application No. 10-2014-0134784 filed Oct. 7, 2014, the disclosure of which is hereby incorporated in its entirety by reference.

FIELD OF THE INVENTION

The present invention relates to a biomass-derived lube base oil and a method for preparing the same. More specifically, the present invention relates to a lube base oil containing an x-type diester dimer and a method for preparing the same.

BACKGROUND OF THE INVENTION

Conventionally, the preparation of mineral oil-derived lube base oils required drilling of crude oil which is buried underground. From a global environment point of view, to prepare mineral oil-derived lube base oils in such a manner is to add carbon buried underground to the surface circulation system of the earth. Used mineral oil-derived lube base oils may be removed by burning or discarded as liquid. During the course of burning, $CO_2$, which would not be added otherwise, is added to the surface circulation system. When discarded as liquid, more serious problems are posed, because mineral oil-derived lube base oils possess a very low biodegradability of about 10 to about 30% (based on the CEC analysis method). The remainder (i.e. the portion not biodegraded) of the mineral oil-derived lube base oils may be absorbed to the ecosystem in the surface circulation system to cause a variety of problems. In addition, from a macroscopic point of view, the problem of serious environmental pollutants, such as S, N, heavy metals, etc. present in the crude oil drilled to produce mineral oil-derived lube base oils, being included in the surface circulation system and causing troubles can never be ignored.

In contrast, the problem of adding carbon ($CO_2$) to the surface circulation system does not occur in the case of biomass-derived lube base oils, because biomass comes from animals or plants which are already present in the surface circulation system, which is to say that carbon already being circulated in the surface circulation system is utilized in this case. The biomass-derived lube base oils inherently have a biodegradability of at least about 70% or more and exhibit a biodegradability of nearly 100%; therefore, there is little negative impact posed on the ecosystem from burning or discharging into the nature the biomass fat-derived lube base oils which are to be discarded after use. Of course, toxic substances such as S, N, heavy metals, aromatics, etc. are not present throughout the preparation process.

Therefore, in order to overcome the above-described problems which the mineral oil-derived lube base oils have, preparation technology for a biomass-derived lube base oil has been proposed as a way to make an ecofriendly lubricating oil which has high biodegradability and is free of toxic substances (S, N, aromatics, heavy metal).

SUMMARY OF THE INVENTION

It is an aspect of the present invention to provide a lube base oil which has excellent low-temperature stability and high biodegradability and thus is ecofriendly, and a preparation method of a lube base oil which does not produce toxic substances such as S, N, aromatic compounds, heavy metals, etc. and thus is ecofriendly, maximizes the content of oleic acid and thus minimizes the dependence on oleic acid while improving processability and economic feasibility during the preparation of a lube base oil, and can easily control the properties of the lube base oil of interest by making changes to the alcohol-based compound to be introduced for an esterification reaction.

One aspect of the present invention relates to a preparation method of a lube base oil. The preparation method of a lube base oil includes: a conversion of biomass fat to fatty acids; a separation of C18 unsaturated fatty acids from the above fatty acids; a maximization of the oleic acid content through partial hydrotreating of the above C18 unsaturated fatty acids; a synthesis of a dimer or a higher-order oligomer through an oligomerization of the above oleic acid; and an esterification of the above oligomer, where the prepared lube base oil contains an x-type diester dimer represented by the following Chemical Formula 1:

[Chemical Formula 1]

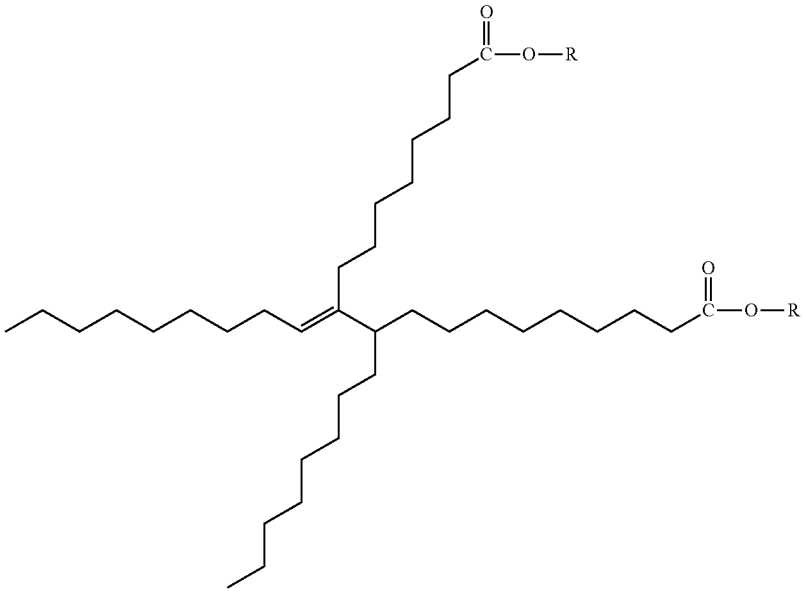

In the above Chemical Formula 1, R represents an alkyl group, a ketone group, an aldehyde group or an ester group having 1 to 12 carbons.

In a specific example, the content of an x-type dicarboxylic acid dimer (represented by the following Chemical Formula 2) in the above oligomer may be about 10 to about 100 wt %.

[Chemical Formula 2]

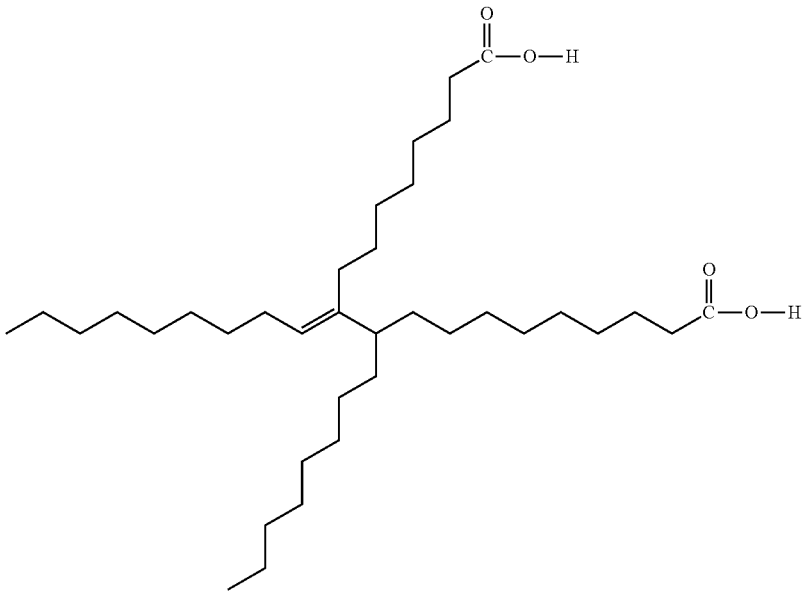

In a specific example, the yield of the x-type dicarboxylic acid dimer represented by the above Chemical Formula 2 may be about 30% or more.

In a specific example, after the synthesis of the above oligomer, a selective separation of the x-type dicarboxylic acid dimer from the synthesized oligomer by a fractional distillation method may be further included.

In a specific example, the above C18 unsaturated fatty acids may include oleic acid, linoleic acid and linolenic acid.

In a specific example, the above partial hydrotreating reaction may be carried out in the presence of a supported catalyst, in which a water-resistant carrier is supported by NiMo, CoMo or Mo metals, under the condition of a reaction temperature of about 160 to about 180° C. and a reaction pressure of about 20 to about 40 bars.

In a specific example, the above water-resistant carrier may be $ZrO_2$ or $TiO_2$.

In a specific example, the content of oleic acid in the above C18 unsaturated fatty acids may be about 90% or more by the above partial hydrotreating reaction.

In a specific example, the above oligomerization reaction may be carried out in the presence of a cationic polymerization catalyst at a reaction temperature of about 180 to about 250° C., and the above cationic polymerization catalyst may be a catalyst based on a zeolite, a montmorillonite or kaolin.

In a specific example, the above esterification reaction may refer to having the above synthesized oligomer and an alcohol-based compound reacted to engage a fatty acid group of the above oligomer and a hydroxyl group of an alcohol-based compound in an esterification reaction.

In a specific example, the above esterification reaction may be carried out in the presence of an acid catalyst or base catalyst at a reaction temperature of 30 to 120° C., and the above acid catalyst may be sulfuric acid ($H_2SO_4$), perchloric acid ($HClO_4$), nitric acid ($HNO_3$) or hydrochloric acid (HCl) having a purity of about 95% or more, whereas the above base catalyst may be potassium hydroxide (KOH), sodium hydroxide (NaOH) or sodium methoxide ($CH_3ONa$) having a purity of about 95% or more.

In a specific example, the above oligomer and above acid catalyst may be mixed in a weight ratio of about 1:about 0.01 to about 1:about 20 to be used in an esterification reaction.

Another aspect of the present invention relates to a lube base oil. The above lube base oil contains an x-type diester dimer represented by the following Chemical Formula 1:

[Chemical Formula 1]

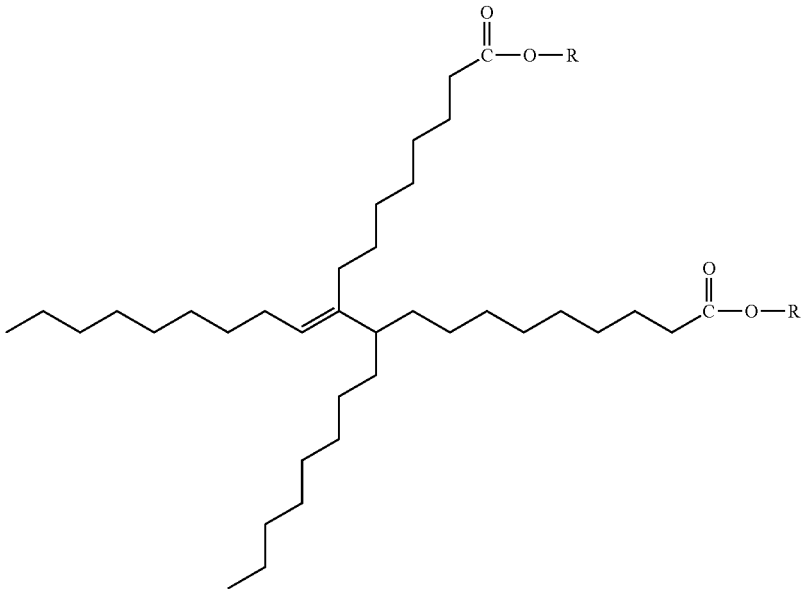

In the above Chemical Formula 1, R represents an alkyl group, a ketone group, an aldehyde group or an ester group having 1 to 12 carbons.

In a specific example, the above lube base oil may have a pour point of about −50 to about −35° C. and a viscosity index of about 115 to about 135.

DETAILED DESCRIPTION OF THE INVENTION

Hereinafter, embodiments of the present invention will be described in more detail.

Preparation Method of Biomass-Derived Lube Base Oil

Figure 1:
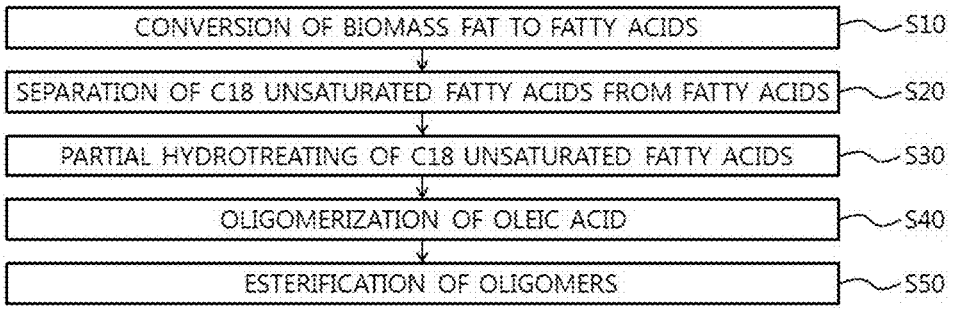
FIG. 1 is a flow chart illustrating step by step a preparation method of a lube base oil according to a specific example of the present invention.

FIG. 1 is a flow chart illustrating step by step a preparation method of a lube base oil according to a specific example of the present invention. Referring to FIG. 1, the preparation method of a lube base oil according to the specific example of the present invention includes: a conversion S10 of biomass fat to fatty acids; a separation S20 of C18 unsaturated fatty acids from the above fatty acids; a maximization S30 of the content of oleic acid through partial hydrotreating of the above C18 unsaturated fatty acids; a synthesis S40 of a dimer or a higher-order oligomer through an oligomerization of the above oleic acid; and an esterification S50 of the above oligomer.

A lube base oil prepared by the above preparation method contains an x-type diester dimer represented by the following Chemical Formula 1. In the present invention, an x-type diester dimer is defined as a diester dimer having 36 carbons (C36 diester dimer) as represented by the following Chemical Formula 1.

[Chemical Formula 1]

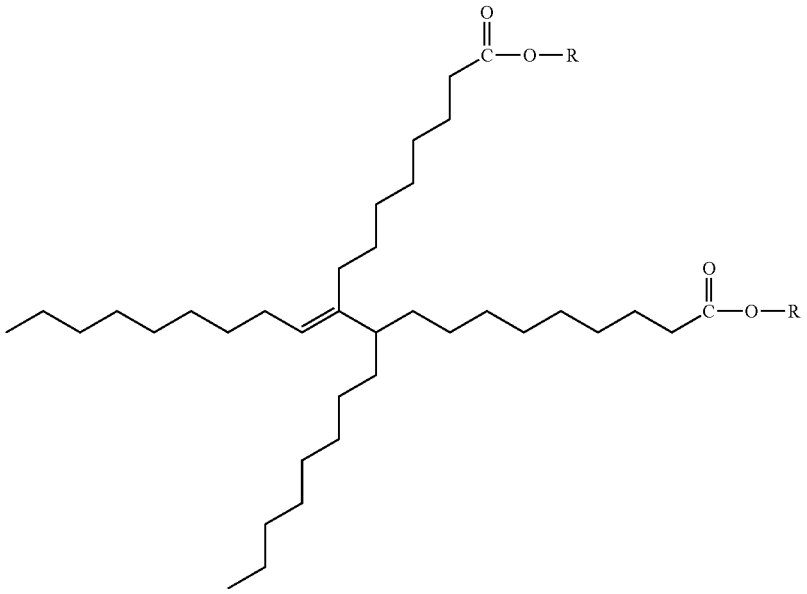

In the above Chemical Formula 1, R represents an alkyl group, a ketone group, an aldehyde group or an ester group having 1 to 12 carbons.

Figure 2:
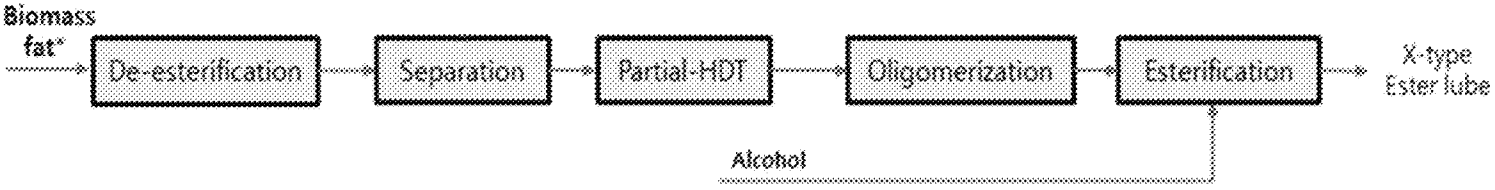
FIG. 2 is a process flow diagram schematically illustrating a preparation method of a lube base oil according to a specific example of the present invention.
Figure 3:
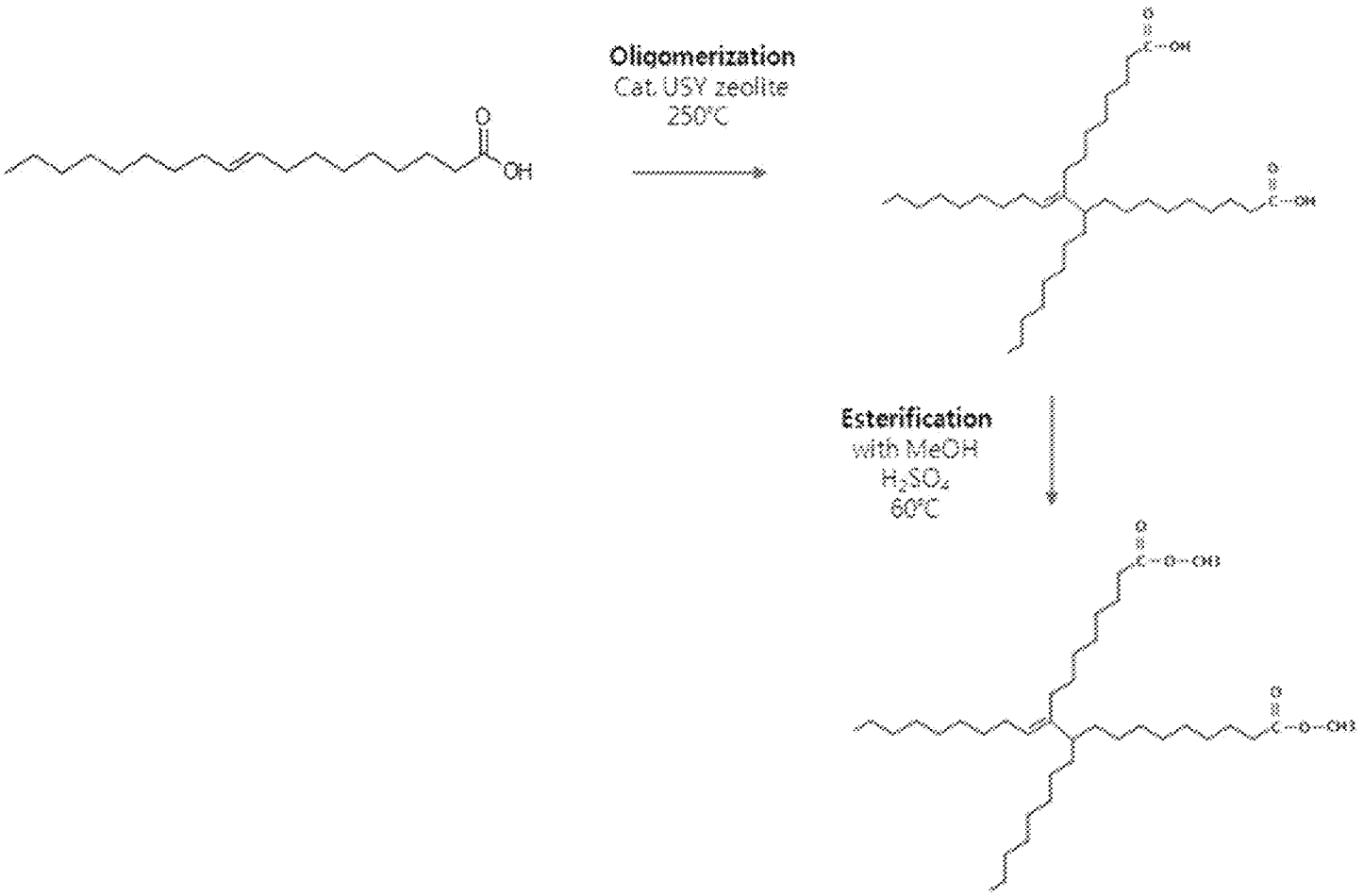
FIG. 3 schematically illustrates a mechanism of an oligomerization reaction and esterification reaction in a preparation method of a lube base oil according to a specific example of the present invention.

FIG. 2 is a process flow diagram schematically illustrating a preparation method of a lube base oil according to a specific example of the present invention, and FIG. 3 schematically illustrates a reaction mechanism of a lube base oil according to a specific example of the present invention. Each step will be described in detail hereinafter with reference to FIG. 2 and FIG. 3.

During the conversion S10 of biomass fat to a fatty acid, as generally known, triglycerides can be extracted from biomass by using a strong acid, a strong base, high temperature steam, etc., and the ester bonds of the above triglycerides can be hydrolyzed to be converted to fatty acids.

The separation S20 of C18 unsaturated fatty acids from the above fatty acids is required because the above biomass-derived fatty acids include a variety of saturated fatty acids and unsaturated fatty acids. For example, a palm oil-derived fatty acid may include myristic acid, palmitic acid, oleic acid, linoleic acid, linolenic acid, monoglycerides and diglycerides. Such various kinds of fatty acids have boiling points different from one another, and thus, fatty acids of interest can be selectively separated by extraction by fractional distillation.

Therefore, biomass-derived fatty acids may be separated into C18 unsaturated fatty acids (boiling point:about 355 to about 380° C.) by extraction through fractional distillation. The above C18 unsaturated fatty acids may include oleic acid, linoleic acid and linolenic acid.

Among the C18 unsaturated fatty acids to be used for an oligomerization reaction which will be described hereinafter, oleic acid is the compound of interest, and thus, linoleic acid and linolenic acid can be directly used for an oligomerization reaction only when they are converted to oleic acid through a reduction in the number of unsaturated bonds.

The maximization S30 of the content of oleic acid through partial hydrotreating of the above C18 unsaturated fatty acids relates to a process of converting linoleic acid (C18:2) or linolenic acid (C18:3), etc. in biomass fat to oleic acid (C18:1).

As a catalyst used for the above partial hydrotreating reaction, a supported catalyst in which a water-resistant carrier is supported by NiMo, CoMo or Mo metal is used.

The above partial hydrotreating reaction is carried out under conditions including a temperature condition of about 160 to about 180° C. and a pressure condition of 20 to 40 bars, not under the conventional hydrotreating conditions including a high temperature of about 200° C. or more and a high pressure of about 40 bars or more. When the reaction is carried out under conditions including a high temperature of 180° C. or more and a high pressure of 20 bars or more, unsaturated double bonds may completely disappear, not as originally intended, to be converted into stearic acid (C18:0), or worse, a decarboxylation reaction may take place, resulting a side reaction producing C15, C17 linear paraffin.

For such reasons, the reaction conditions required to limit the number of unsaturated double bonds to 1 through a partial saturation of an olefin having two or more unsaturated double bonds should be limited to the above. Even if only a part of the olefins having two or more unsaturated double bonds is converted to olefins having one unsaturated double bond, all of the olefins having two or more unsaturated double bonds are treated eventually through recycling, therefore, inhibition of side reactions is an issue more important than the yield of reaction.

In addition, differences from the conventional hydrotreating conditions come from unique characteristics of biomass itself. Biomass has a very high oxygen content as compared to crude oil. When oxygen is removed by hydrotreating, the oxygen to be removed reacts with hydrogen and is removed in a form of $H_2O$, thus resulting in a reactive metal and carrier of the catalyst to leach out which causes a serious deactivation of catalyst. Therefore, in most cases of hydrotreating biomass, there may be serious deactivation reactions of catalysts due to water produced as the by-product.

The present invention uses a water-resistant carrier such as $ZrO_2$ and $TiO_2$ to overcome a problem of catalyst deactivation resulting from a catalyst leaching phenomenon.

In the oligomerization S40 of the above oleic acid, an x-type dicarboxylic acid dimer is synthesized by inducing oligomerization reactions among the unsaturated double bonds present in oleic acid.

The oligomers synthesized by the above oligomerization reaction are mostly dimers, but oligomers having higher orders than trimers and tetramers may also be present, and these high-order oligomers may also be used as lube base oils.

As the catalyst to be used for the above oligomerization reaction, a cationic polymerization catalyst, a metallocene catalyst, a Ziegler-Natta catalyst, etc. may be used, and most prominently, a cationic polymerization catalyst may be used.

For the above cationic polymerization catalyst, for example, a zeolite, a montmorillonite or clays such as kaolin may be used. The above cationic polymerization catalyst may be in a form of SAPO, AlPO, etc. and a supported catalyst in which a mesoporous silica carrier such as SBA-15, MCM-41, MCM-48, etc. is supported by aluminum (Al). The content of Al in the above supported catalyst may be about 0.1 to about 50 wt %, specifically, about 5 to about 35 wt %.

As the above zeolite catalyst, Y-zeolite (especially, USY zeolite having a high SAR (silica alumina ratio), ZSM-5, beta-zeolite, etc.) may be used.

In addition, hydrotalcite, a metal catalyst with a spinel structure, a catalyst (e.g. niobic acid) containing a strong acid site may also be used.

Further, an RFCC catalyst in which Y-zeolite and kaolin are mixed, specifically, an RFCC flash catalyst or RFCC equilibrium catalyst (E-cat.) may also be used.

In a specific example, the above oligomerization reaction may be carried out in a batch reactor in the presence of the above-described catalyst under a reaction temperature condition of about 120 to about 400° C., specifically, about 150 to about 300° C., more specifically, about 180 to about 250° C. for about 1 minute to about 24 hours, specifically, about 30 minutes to about 5 hours.

In another specific example, the above oligomerization reaction may be carried out in a continuous reactor such as a CSTR reactor. In the above continuous reactor, the weight hourly space velocity (WHSV) may be about 0.01 to about 10 $hr^{-1}$, specifically, about 0.1 to about 5 $hr^{-1}$.

Coke formed on the catalyst after the oligomerization reaction may be removed in a simple manner of air burning or calcination, and, accordingly, the catalyst activity returns close to the initial state.

On the other hand, when a metallocene or Ziegler-Natta catalyst is used, typically it may be beneficial to carry out a reaction under a temperature condition of about 100° C. or less, but it is not limited thereto.

When oleic acid is introduced to the above batch or continuous reactor, it is preferable in terms of ease of operation that the injection is done in a form of a liquid mixture prepared by mixing with a solvent. As the above solvent, a light paraffin such as n-heptane may be used, and oleic acid and the solvent may be mixed in a weight ratio of about 1:about 0.1 to about 1:about 10.

A dimer or higher-order oligomer may be synthesized by the above oligomerization reaction. For example, the following Chemical Formula 2 shows a synthesized x-type dicarboxylic acid dimer. In the present invention, an x-type dicarboxylic acid dimer is defined as a dicarboxylic acid dimer having 36 carbons (C36 dicarboxylic acid dimer) represented by the following Chemical Formula 2. The dimer represented by the following Chemical Formula 2 has an x-type chemical structure, and thus, it can eventually provide more improved low-temperature stability to a lube base oil of interest.

[Chemical Formula 2]

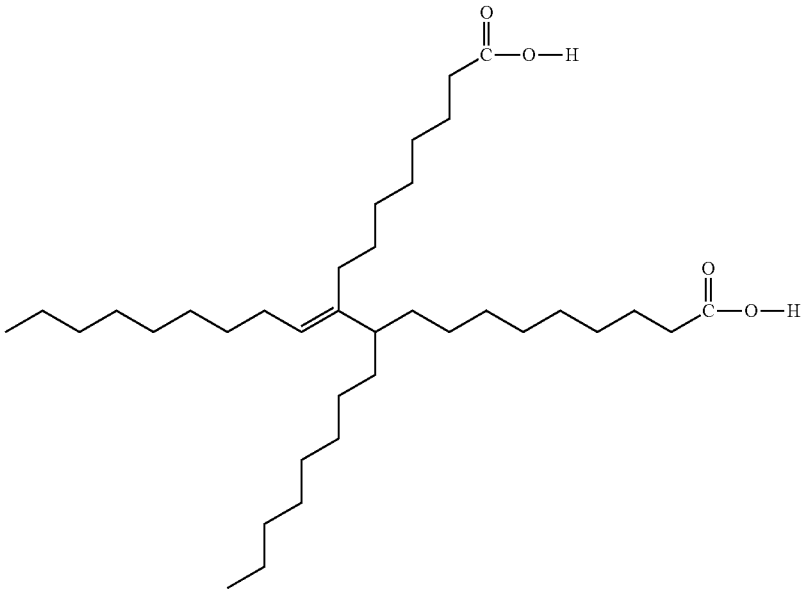

The content of dimers in the above oligomer may be about 10 to about 100 wt %, and the mole ratio of dimers to trimers and higher-order oligomers may be about 1:about 0.001 to about 1:about 0.5.

The yield of the x-type dicarboxylic acid dimer represented by the above Chemical Formula 2 from the above oligomerization reaction may be about 30% or more.

After a synthesis of the above oligomer, a selective separation of dimers from the synthesized oligomer may be further included. For example, a synthesized x-type dicarboxylic acid dimer has a boiling point of about 450 to about 550° C., and thus, dimers can be selectively separated by a fractional distillation method.

In the esterification S50 of the above oligomer, a fatty acid of the synthesized oligomer undergoes an esterification reaction with a hydroxyl group of an alcohol-based compound to convert the molecular structure of the oligomer to an ester.

The x-type dicarboxylic acid dimer obtained by an oligomerization reaction contains a carboxylic functional group, and thus, it may cause corrosion in an engine. Therefore, a stabilization of the chemical structure of the carboxylic functional group to an ester form through an esterification reaction with alcohol is required.

There is no particular limitation to the alcohol-based compound to be used in an esterification reaction, as long as it is an alcohol-based compound having a hydroxyl group, and, an alcohol based compound such as methanol, ethanol, octadecanol, 1,6-hexanediol, 1,9-nonanediol, neopentyl glycol, triethylene glycol, diethylene glycol, pentaerythritol, thiodiethylene glycol, N,N'-bis(hydroxyethyl)oxamide, trimethyl hexanediol, etc. may be used for the purpose. However, low-price methanol, ethanol, etc., which are less expensive than the final product and a volume gain effect through a preparation of esters can be expected with the use thereof, may be used.

However, in order to control particular properties of a lube base oil such as a viscosity index, a pour point, etc., an alcohol-based compound having a more complicated structure may be applied for a preparation of an ester lube. For example, when an alcohol-based compound has a long hydrocarbon chain, the properties may degrade in terms of the pour point but improve in terms of the viscosity index. In another example, when an alcohol compound having a side chain in a beta position is applied, an improvement in the structural stability of the ester lube may be expected. In order to induce changes in the properties of a lube base oil in relation to the chemical structural properties of an alcohol compound as such, various alcohol compounds can be applied and adopted as needed.

The above esterification reaction is carried out at a reaction temperature of about 30 to about 120° C. in the presence of an acid catalyst or base catalyst, and the above acid catalyst may be sulfuric acid ($H_2SO_4$), perchloric acid ($HClO_4$), nitric acid ($HNO_3$) or hydrochloric acid (HCl) having a purity of about 95% or more, and the above base catalyst may be potassium hydroxide (KOH), sodium hydroxide (NaOH) or sodium methoxide ($CH_3ONa$) having a purity of about 95% or more, but they are not limited thereto.

In the above esterification reaction, the oligomer and acid catalyst or base catalyst may be mixed in a weight ratio of about 1:about 0.01 to about 1:about 20, specifically, about 1:about 0.03 to about 1:about 20 for an esterification reaction.

Lube Base Oil Containing x-Type Diester Dimer

The lube base oil prepared by the above-described preparation method may contain an x-type diester dimer represented by the following Chemical Formula 2.

[Chemical Formula 2]

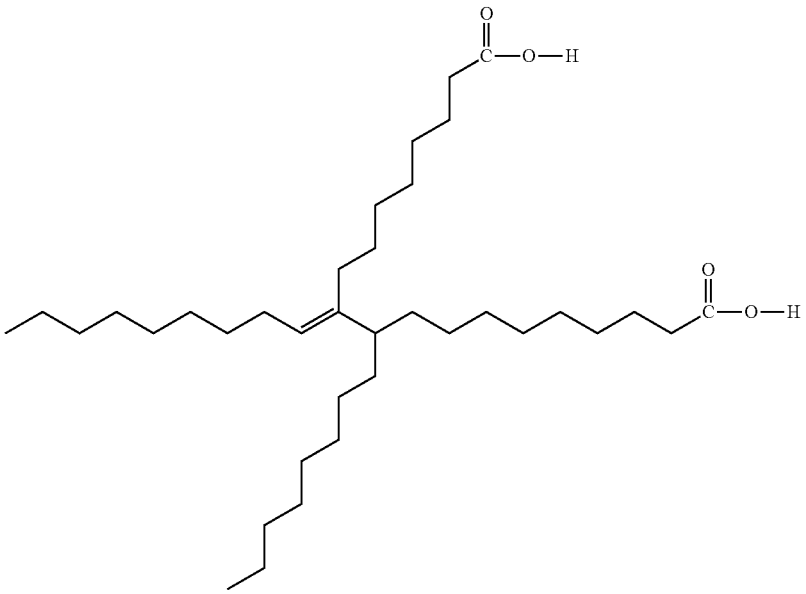

In the above Chemical Formula 2, R represents an alkyl group, a ketone group, an aldehyde group or an ester group having 1 to 12 carbons.

The lube base oil containing an x-type diester dimer represented by the above Chemical Formula 2 has advantages as an ecofriendly lubricating oil, for example, high biodegradability, high viscosity index and excellent low-temperature stability.

Conventional ester lubes have relatively low steric hindrance, and thus, a conversion to fatty acids as a result of chemical structure disintegration has been highly probable, and there has been a problem of corrosion actually occurring as a result of such a side reaction. In contrast, an x-type diester dimer represented by the above Chemical Formula 1 contains an ester functional group with a high steric hindrance in its chemical structure, and thus, preventing a conversion to an acid of an ester.

A lube base oil according to a specific example of the present invention may have a viscosity of about 4 to about 8 cSt at about 100° C., a pour point of about −50 to about −35° C., a viscosity index of about 115 to about 135, thus having a relatively high viscosity index with respect to a pour point.

Hereinafter, the present invention will be described in more detail with reference to examples, but such examples are merely for illustrative purposes and should not be construed as limiting the present invention.

Example

A. Separation of Fatty Acids

Figure 4:
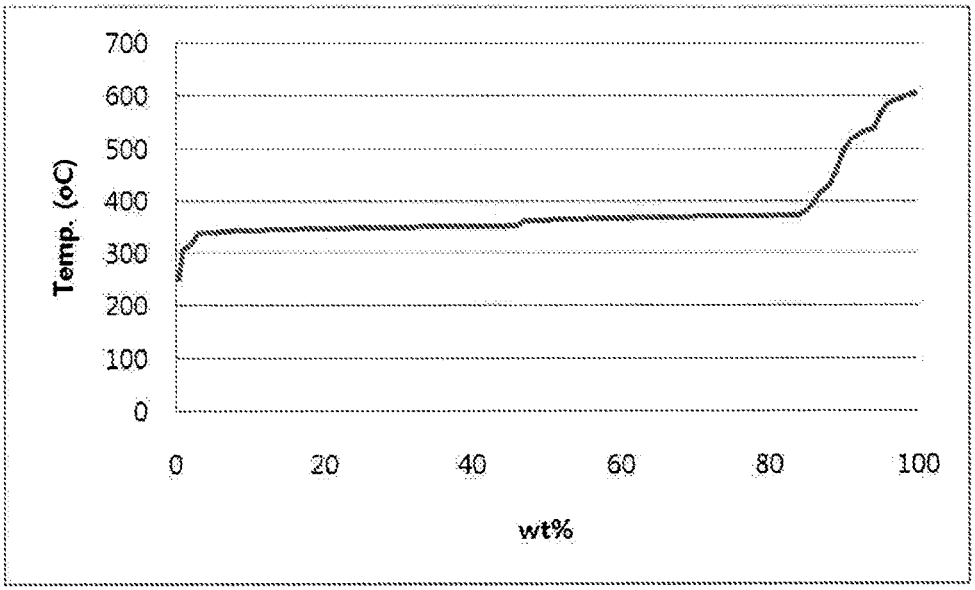
FIG. 4 graphically illustrates fatty acid separation from a palm fatty acid distillate specimen at various temperatures.

Fatty acids were separated from a 2 kg-PFAD (palm fatty acid distillate) specimen by a TBP cutting device at various reaction temperatures. The analyzed result of the above PFAD specimen is shown in FIG. 4, and from the result, it was found that the PFAD specimen had a composition as shown in the Table 1 below. The PFAD specimen underwent cutting based on 300° C., 355° C., 380° C. for an acquisition of each fatty acid in the amount as shown in the Table 2 below.

TABLE 1

| Type of fatty acids | PFAD composition (wt %) |
|---|---|
| Myristic acid (C14:0) | 3 |
| Palmitic acid (C16:0) | 43 |
| Oleic acid (C18:1), Linoleic acid (C18:2), Linolenic acid (C18:3) | 38 |
| Monoglyceride, diglyceride | 16 |
| Total | 100 |

TABLE 2

| Type of fatty acids | Boiling point | Amount of each fatty acid separated and acquired (g) |
|---|---|---|
| Myristic acid (C14:0) | 300° C. or less | 56 |
| Palmitic acid (C16:0) | 300 to 355° C. | 881 |
| Oleic acid (C18:1), Linoleic acid (C18:2), Linolenic acid (C18:3) | 355 to 380° C. | 742 |
| Monoglyceride, diglyceride | 380° C. or more | 289 |
| Total | — | 1968 |

B. Partial Hydrotreating Reaction to Maximize Yield of Oleic Acid 742 g of the C18 fatty acids (C18:1, C18:2, C18:3) acquired during the above separation of fatty acids underwent partial hydrotreating in the presence of a NiMo/$ZrO_2$ catalyst for a conversion of linoleic acid (C18:2) and linolenic acid (C18:3) to oleic acid (C18:1).

The result of GC-MS analysis shows that the selectivity in the conversion of linoleic acid and linolenic acid to oleic acid is high as shown in the Table 3 below.

TABLE 3

| | Change in content before and after partial hydrotreating reaction (wt %) | |
|---|---|---|
| Type of fatty acids | Before | After |
| Oleic acid (C18:1) | 80.3 | 93.9 |
| Linoleic acid (C18:2) | 17.9 | 5.9 |
| Linolenic acid (C18:3) | 1.8 | 0.2 |

After the partial hydrotreating reaction, the products as in the Table 3 above were introduced into a 500 cc-flask which was then connected to fractional distillation equipment (Spaltrohr HMS 300C by Fischer Technology, Inc.) to perform fractional distillation to finally obtain 682 g of oleic acid.

C. Oligomerization Reaction of Oleic Acid 341 g of oleic acid among the 682 g of oleic acid obtained from the Step B above was introduced with 17 g of USY zeolite into a 500 cc-flask, the reaction temperature was raised and maintained under the condition of 250° C. and a stirring speed of 1000 rpm for 6 hours. The above USY zeolite is of an H-form and has a surface area of 778 m2/g, SAR (Silica alumina ratio) of 78 and an average UCS of 24.24 A. After the reaction is completed, the temperature was gradually lowered, and then the reaction products were transferred to a 1 L-beaker. To this, 350 cc of n-heptane was added and dispersed, and then it was filtered to separate the zeolite catalyst from the reaction products. The reaction products which underwent separation was stored in a rotary evaporator (60 mbars, 85° C., 200 rpm) for 6 hours for selective removal of n-heptane. The yield and history of side reactions of the pure reaction products obtained were confirmed by a Simdist analysis. Later, the acquired reaction products were again introduced into the fractional distillation equipment (Spaltrohr HMS 300C by Fischer Technology, Inc.), underwent cutting at 450° C. to be removed of unconsumed reactants, and x-type dicarboxylic acid dimers corresponding to boiling points of 450 to 550° C. among the produced oligomers were selectively separated. The separated, unconsumed oleic acid was 101.5 g, the acquired x-type dicarboxylic acid dimer was 155.4 g and the residues having a boiling point of 550° C. or more was 55 g.

D. Esterification Reaction of x-Type Dicarboxylic Acid Dimmers 155.4 g of the x-type dicarboxylic acid dimer acquired from the Step C above and 47 g of methanol were introduced with 5.6 g of a 99% pure sulfuric acid, the reaction temperature was raised to 60° C., and was stored for 12 hours at a stirring speed of 200 rpm. Later, the above products were added to a 1 L-beaker and then quenched with a mixed solution of KOH/Ethanol/DI-water (6.3 g/100 cc/900 cc) while being stirred. The pH was measured to confirm that no residual acid was present in the above mixed solution, and then the mixed solution was set aside to wait for the temperature to decrease, added to a separatory funnel and maintained, and then, when the water layer and organic layer were separated from each other, the water layer was selectively removed. The separated organic layer was again added to the fractional distillation equipment (Spaltrohr HMS 300C by Fischer Technology, Inc.) and underwent cutting at 560° C. to be removed of unconsumed reactants. The separated, unconsumed reactants were 28 g, and the acquired x-type diester dimer compound was 114 g.

Properties as a lubricating oil of the above x-type diester dimer compound were measured, and the result is shown in the Table 4 below.

TABLE 4

| Viscosity (40° C.) | Viscosity (100° C.) | Viscosity Index (VI) | Pour point (PP) | TAN (mgKOH/kg) |
|---|---|---|---|---|
| 48 cSt | 7.7 cSt | 125 | −43° C. | 0.1 |

As seen in the Table 4 above, an x-type diester dimer compound prepared through an example of the present invention was found to have excellent properties of a lube base oil in terms of a viscosity index and a pour point.

So far, examples of the present invention has been described, and it should be understood that the present invention is not limited by the above examples but can be prepared in various different forms and implemented in other specific forms by an ordinary person skilled in the art, without changing the technical scope or essential features of the present invention. Therefore, the examples described above should be understood as exemplary and non-limiting in every aspect.

What is claimed is:

1. A preparation method of a lube base oil, the method comprising:

converting biomass fat to a fatty acid;

separating a C18 unsaturated fatty acid from the fatty acid;

maximizing an oleic acid content through partial hydrotreating of the C18 unsaturated fatty acid;

synthesizing an oligomer which is a dimer or a higher-order oligomer through an oligomerization of the oleic acid; and esterifying the oligomer, wherein the lube base oil includes an x-type diester dimer represented by the following Chemical Formula 1:

[Chemical Formula 1]

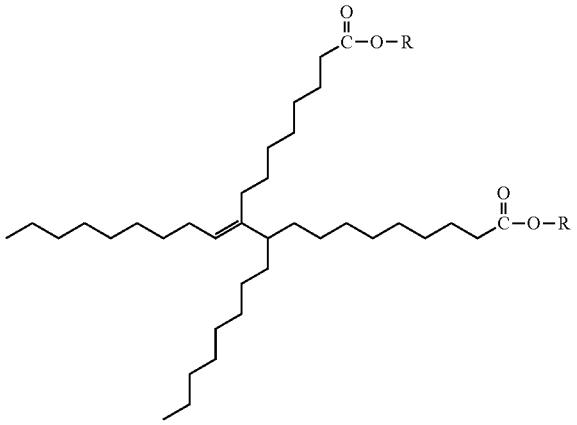

where in the Chemical Formula 1, R represents an alkyl group, a ketone group, an aldehyde group or an ester group having 1 to 12 carbons.

2. The preparation method of claim 1, wherein the oligomer contains an x-type dicarboxylic acid dimer represented by the following Chemical Formula 2 at about 10 to about 100 wt %

[Chemical Formula 2]

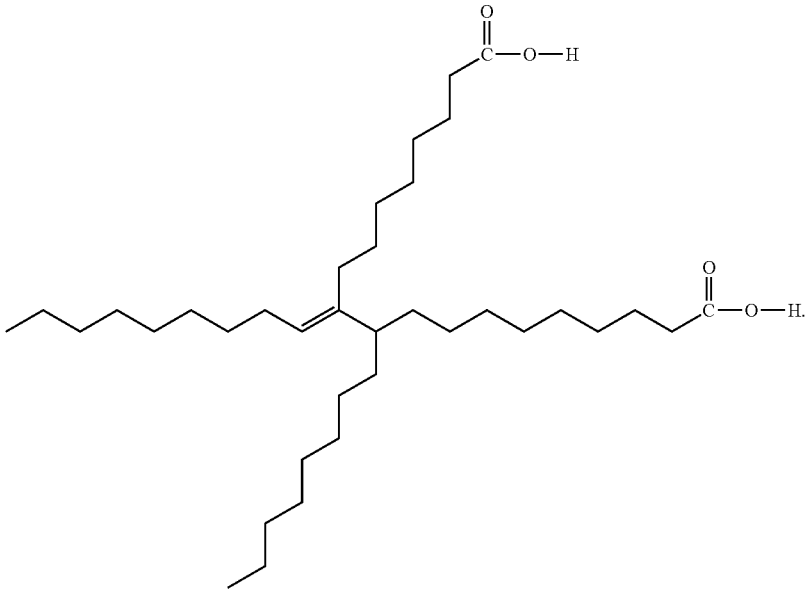

3. The preparation method of claim 2, wherein the x-type dicarboxylic acid dimer represented by the above Chemical Formula 2 has a yield of 30% or more.

4. The preparation method of claim 1 further comprising:

selectively separating an x-type dicarboxylic acid dimer from the synthesized oligomer by a fractional distillation method after synthesizing the oligomer.

5. The preparation method of claim 1, wherein the C18 unsaturated fatty acid includes oleic acid, linoleic acid and linolenic acid.

6. The preparation method of claim 1, wherein the partial hydrotreating is carried out in a presence of a supported catalyst, in which a water-resistant carrier is supported by NiMo, CoMo or Mo metals, under a condition of a reaction temperature of about 160 to about 180° C. and a reaction pressure of about 20 to about 40 bars.

7. The preparation method of claim 6, wherein the water-resistant carrier is $ZrO_2$ or $TiO_2$.

8. The preparation method of claim 1, wherein the oleic acid content in the C18 unsaturated fatty acid is about 90% or more as a result of the partial hydrotreating.

9. The preparation method of claim 1, wherein the oligomerization is carried out at a reaction temperature of about 180 to about 250° C. in a presence of a cationic polymerization catalyst and the cationic polymerization catalyst is a catalyst based on a zeolite, a montmorillonite or kaolin.

10. The preparation method of claim 1, wherein the esterifying is the synthesized oligomer reacting with an alcohol-based compound so that a fatty acid of the synthesized oligomer reacts with a hydroxyl group of the alcohol-based compound in an esterification reaction.

11. The preparation method of claim 10, wherein the esterification reaction is carried out in a presence of an acid catalyst or base catalyst at a reaction temperature of about 30 to about 120° C., the acid catalyst is sulfuric acid ($H_2SO_4$), perchloric acid ($HClO_4$), nitric acid ($HNO_3$) or hydrochloric acid (HCl), having a purity of about 95% or more, and the base catalyst is potassium hydroxide (KOH), sodium hydroxide (NaOH) or sodium methoxide ($CH_3ONa$), having a purity of about 95% or more.

12. The preparation method of claim 11, wherein the oligomer and the acid catalyst are mixed in a weight ratio of about 1:about 0.01 to about 1:about 20 for the esterification reaction.

13. A lube base oil comprising an x-type diester dimer which is represented by the following Chemical Formula 1:

[Chemical Formula 1]
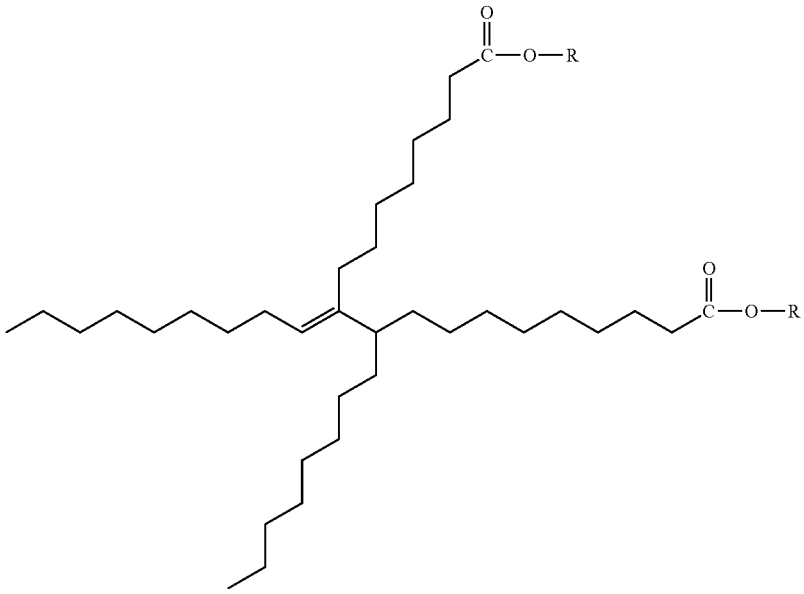
where in the Chemical Formula 1, R represents an alkyl group, a ketone group, an aldehyde group or an ester group having 1 to 12 carbons.
14. The lube base oil of claim 13 having a pour point of about −50 to about −35° C. and a viscosity index of about 115 to about 135.
* * * * *